US010876759B2

(12) United States Patent
Fang

(10) Patent No.: US 10,876,759 B2
(45) Date of Patent: Dec. 29, 2020

(54) DRY OPEN WINDOW (DOW) APPARATUS

(71) Applicant: Zhihua Fang, Canton, MI (US)

(72) Inventor: Zhihua Fang, Canton, MI (US)

(73) Assignee: Zhihua Fang, Canton, MI (US)

( * ) Notice: Subject to any disclaimer, the term of this patent is extended or adjusted under 35 U.S.C. 154(b) by 0 days.

(21) Appl. No.: 16/515,627

(22) Filed: Jul. 18, 2019

(65) Prior Publication Data

US 2019/0338984 A1 Nov. 7, 2019

Related U.S. Application Data

(63) Continuation-in-part of application No. 15/933,938, filed on Mar. 23, 2018, now Pat. No. 10,378,787, which is a continuation of application No. 14/251,109, filed on Apr. 11, 2014, now Pat. No. 9,927,141, which is a continuation-in-part of application No. 12/836,574, filed on Jul. 14, 2010, now Pat. No. 10,386,090.

(51) Int. Cl.

| | |
|---|---|
| ***F24F 13/08*** | (2006.01) |
| ***E06B 7/082*** | (2006.01) |
| ***F24F 7/00*** | (2006.01) |

(52) U.S. Cl.

CPC ..... *F24F 13/082* (2013.01); *E06B 7/082* (2013.01); *F24F 2007/003* (2013.01); *F24F 2221/52* (2013.01)

(58) Field of Classification Search

CPC ..... F24F 13/082; F24F 2007/2003; F24F 2221/52; E06B 7/082

USPC ..... 454/196, 212, 224, 905

See application file for complete search history.

(56) References Cited

U.S. PATENT DOCUMENTS

| | | | | |
|---|---|---|---|---|
| 1,118,365 | A | | 11/1914 | Loehler |
| 1,173,548 | A | | 2/1916 | Beahan |
| 1,307,479 | A | | 6/1919 | Bolte |
| 1,529,711 | A | | 3/1925 | Parrot et al. |
| 1,754,559 | A | | 4/1930 | Johnson |
| 1,798,540 | A | | 3/1931 | Kelly |
| 1,949,653 | A | * | 3/1934 | Moore ..... E06B 9/304 160/170 |
| 2,139,781 | A | | 12/1938 | Trammell |
| 2,155,985 | A | | 4/1939 | Waterman |
| 2,210,516 | A | | 8/1940 | Wheeler |
| 2,228,224 | A | | 1/1941 | Benson |
| 2,246,413 | A | | 6/1941 | Jones |
| 2,305,445 | A | | 12/1942 | Poor |
| 2,325,003 | A | | 7/1943 | Backwith et al. |
| 2,334,454 | A | | 11/1943 | Taylor |

(Continued)

*Primary Examiner* — Vivek K Shirsat

(74) *Attorney, Agent, or Firm* — Dinsmore & Shohl LLP

(57) ABSTRACT

An environmental window apparatus includes at least two dry open window (DOW) assemblies stacked on top of each other. Each DOW assembly includes a dry open window (DOW) structure having a plurality of louvers which, when viewed in cross section, have "V" or "W" shapes that enable air to pass through a window opening while limiting passage of precipitation, the precipitation being captured by the louvers for collection or drainage and a plurality of vertical members supporting the louvers in a spaced apart arrangement. A plurality of vertical rods are fixed to the vertical members of each DOW assembly by fasteners in a spaced apart arrangement to hold the DOW assemblies in place.

6 Claims, 17 Drawing Sheets

(56) References Cited

U.S. PATENT DOCUMENTS

| | | | | |
|---|---|---|---|---|
| 2,341,233 | A | 2/1944 | Norton | |
| 2,404,178 | A * | 7/1946 | Johnson | E04F 10/10 49/86.1 |
| 2,469,903 | A | 5/1949 | Swanski | |
| 2,487,108 | A | 11/1949 | DeCarlo | |
| 2,527,989 | A | 10/1950 | Fuller | |
| 2,592,579 | A * | 4/1952 | Kramer | E04F 10/10 49/74.1 |
| 2,633,191 | A | 3/1953 | Curtis | |
| 2,741,973 | A | 4/1956 | Swor | |
| 2,779,402 | A | 1/1957 | Canning | |
| 3,008,403 | A | 11/1961 | Van DeVeire | |
| 3,086,442 | A | 4/1963 | Waldron | |
| 3,151,714 | A | 10/1964 | Kennedy | |
| 3,287,870 | A | 11/1966 | Johnson | |
| 3,358,580 | A | 12/1967 | Freese et al. | |
| 3,628,442 | A | 12/1971 | Nijhuis | |
| 3,771,430 | A | 11/1973 | Lane | |
| 3,782,050 | A | 1/1974 | Dowdell et al. | |
| 3,991,533 | A | 11/1976 | Nagase | |
| 4,064,670 | A | 12/1977 | Lichtenwald | |
| 4,103,468 | A | 8/1978 | Olsen | |
| 4,252,076 | A | 2/1981 | Williams | |
| 4,263,842 | A | 4/1981 | Moore | |
| 4,310,993 | A | 1/1982 | White | |
| 4,365,930 | A | 12/1982 | Ogura et al. | |
| 4,452,024 | A | 6/1984 | Sterriker et al. | |
| 4,858,400 | A | 8/1989 | Foyt | |
| 4,958,555 | A | 9/1990 | Lentz et al. | |
| 5,334,091 | A | 8/1994 | Shih-Chin | |
| 5,465,776 | A | 11/1995 | Mirza | |
| 5,542,224 | A | 8/1996 | Olsen | |
| 5,658,130 | A | 8/1997 | Goldstein et al. | |
| 5,782,051 | A | 7/1998 | LaVoie | |
| 5,979,533 | A | 11/1999 | Dupuie | |
| 6,196,292 | B1 | 3/2001 | Jackson | |
| 6,286,579 | B1 | 9/2001 | Gottschalk | |
| 6,378,262 | B1 | 4/2002 | Mercadante | |
| 6,658,793 | B2 | 12/2003 | Perron | |
| 6,745,522 | B2 | 6/2004 | Germain | |
| 6,923,250 | B2 | 8/2005 | Hegg et al. | |
| 7,165,596 | B1 | 1/2007 | Helton | |
| 9,927,141 | B2 | 3/2018 | Fang | |
| 2005/0252086 | A1 | 11/2005 | Yorgason | |
| 2007/0144454 | A1 | 6/2007 | Lee et al. | |
| 2007/0187042 | A1 | 8/2007 | Kallstrom | |
| 2008/0207112 | A1 | 8/2008 | Michieli | |
| 2010/0099349 | A1 | 4/2010 | Gohring et al. | |
| 2010/0332034 | A1 | 12/2010 | Bergeson et al. | |
| 2011/0039490 | A1 | 2/2011 | Wiese | |
| 2011/0093122 | A1 | 4/2011 | Koumoudis | |
| 2011/0162808 | A1 | 7/2011 | Castel | |
| 2012/0015596 | A1 | 1/2012 | Fang | |
| 2012/0060802 | A1 | 3/2012 | Livingston | |

* cited by examiner

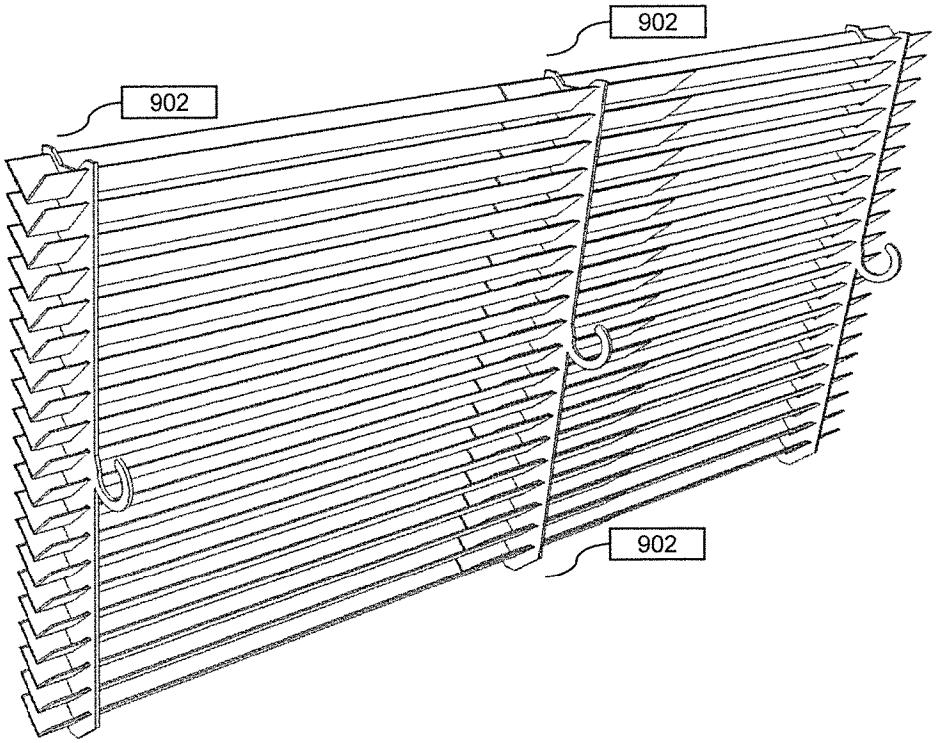
Figure 9A
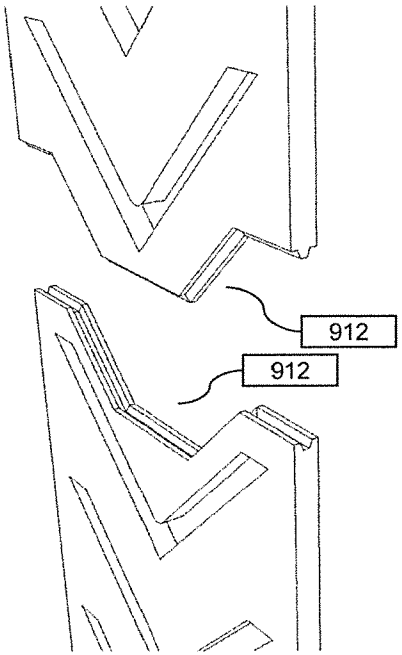
Figure 9B
Figure 9C

DRY OPEN WINDOW (DOW) APPARATUS

REFERENCE TO RELATED APPLICATION

This application is a continuation-in part application of U.S. patent application Ser. No. 15/933,938, filed Mar. 23, 2018, which is a continuation of U.S. patent application Ser. No. 14/251,109, filed Apr. 11, 2014, which is a continuation-in-part application of U.S. patent application Ser. No. 12/836,574, filed Jul. 14, 2010; the entire content of each of which are incorporated herein by reference.

FIELD OF THE INVENTION

This invention relates generally to dry open window (DOW) structures that let fresh air in but keep precipitation out and, in particular, to improvements in the manufacture, mounting and implementation of such structures.

BACKGROUND OF THE INVENTION

When windows are left open for fresh and cool air, rain and other forms of precipitation may come inside, particularly if blown in by wind. An open window is an invitation for flooding on any rainy day, especially during a windy thunderstorm. Therefore one cannot leave an open window unattended during the day when it may rain. During the evening, if a window is open to let in fresh cool air, if it starts to rain one may have to suffer the inconvenience of waking up, going to the open window now soaked in rain, closing the window, drying up the wet spot on the floor, and then trying to go back to sleep. This interrupts a good night's sleep, not to mention damaging the property around or below the window.

Although louvered windows have existed for a long time and are used in some houses in certain regions far south where the weather is mild, they cannot keep rain out when there is a steady wind, thus making them prone to flooding.

The alternative to the open window is most likely a closed window, which in hot weather necessitates the operation of an air-conditioning system. Without air conditioning, one would have to suffer the heat and suffocation in a close-off building or space. As energy becomes more and more expensive, and the world becomes more environmentally conscious, more people would like to have an open window to let the air flow through their residences or businesses. Yet, inclement weather makes the open window a liability, an inconvenience, and sometimes impossibility.

To address these problems, my U.S. patent application Ser. No. 12/836,574 discloses various devices that perform the dual function of letting fresh air in or through a building or structure while keeping rain out in inclement weather. Such devices, which I call dry-open-window or "DOW" devices, allow fresh air into a building or structure while keeping the rain out at wind speeds up to a certain limit. My published application also discloses a device in which a fan will be added to the DOW device, to further enhance the flow of the air from outside but will keep the rain out at the same time at wind speeds up to a predetermined limit.

More particularly, the DOW device is disposed in an open window or any opening, and secured against the window frame or the frame of the opening, to let the air through the window or opening. At the same time, however, the DOW device keeps rain drops or any other precipitation from entering the window or opening even though the rain drops or precipitation may be forced towards the window or opening, as by a wind or any other air movement.

The DOW fan works in conjunction with the DOW, and has all the functions of DOW, but includes a mechanized fan, typically driven by electricity, to increase the air flow through the window or the opening in either direction, but to keep rain drops or any other precipitation from entering the window or opening.

SUMMARY OF THE INVENTION

This invention resides in environmental window apparatus with the goal being to extend and improve upon existing dry open window (DOW) structures. Such structures comprise a plurality of louvers which, when viewed in cross section, have "V" or "W" shapes that enable air to pass through a window opening while substantially preventing precipitation to pass, the precipitation instead being captured by the louvers for collection or drainage.

One aspect of the invention resides in apparatus for mounting the DOW structure in overlying registration around the periphery of an existing window opening having a height and a width. Such mounting apparatus may include four corner frame members around and containing the DOW structure, each frame member having a first arm greater than half the height of the window opening and a second arm greater than half the width of the window opening. The first arm of each frame member is slidingly engaged with the second arm of an adjacent frame member, with fasteners being provided to lock the frame members to one another when they form an assembled rectangle with dimensions corresponding to the periphery around the window opening. A plurality of components are then provided for mounting the frame members and DOW structure contained therein to the periphery of the window opening.

The components for mounting the frame members and DOW structure contained therein may, for instance, include a plurality of threaded fasteners that extend through portions of the assembled rectangle and around the periphery of the window opening. Alternatively, the components for mounting the frame members and DOW structure contained therein may include a plurality of hook-and-loop fasteners between the assembled rectangle and the periphery of the existing window opening.

A plurality of cables may be provided, each with one end mounted to different points around the periphery of the window opening, and wherein the cables then extend through portions of the frame assembly. In this embodiment, a mechanism for tightening the cables is provided such that the frame members and DOW structure are pulled against the existing window opening in overlying registration with the periphery thereof.

The existing window opening forms part of a collapsible tent structure made from tent materials. In this embodiment, the components for mounting the frame members and DOW structure contained therein may include a plurality of fasteners that extend through portions of the assembled rectangle, around the periphery of the window opening, and through the fabric of the tent materials. A roll-up cover may be provided over the mounted frame members and DOW structure. In this and all other embodiments, one or more weep holes may be provided along a bottom portion of the assembled frame to enable water to leak out.

The DOW structure may include a plurality of vertical members through which the louvers extend, each vertical member including a plurality of holes or hooks. In this case, the components for mounting the DOW structure includes a plurality of spaced-apart, telescoping rods that span the width of the existing window opening, and wherein the holes or hooks on the DOW structure engage with the rods to maintain the DOW structure in overlying registration with the window opening.

The DOW structure includes a plurality of vertical members through which the louvers extend, and each vertical member may feature an upper shape and a lower shape. In this embodiment the upper and lower shapes engage with one another, enabling a plurality of DOW structures to stack on top of one another to increase the height of the overall assembly.

The invention may further include a cable assembly enabling the angles of the louvers to be varied in accordance with weather conditions. The invention may additionally include a cable assembly enabling the spacing between the louvers to be varied in accordance with weather conditions or for shipment prior to assembly.

In another embodiment, the environmental window apparatus may include at least two dry open window (DOW) assemblies stacked on top of each other. Each DOW assembly may include a dry open window (DOW) structure having a plurality of louvers which, when viewed in cross section, are formed in the shape of a "V" or "W" that enable air to pass through a window opening while limiting passage of precipitation, the "V" shape disposed with a narrower end pointed downward and two portions sloping upwardly therefrom or the "W" shape disposed with two narrower ends of the shape pointed downward and two portions sloping upwardly from each of the narrower ends such that the precipitation instead is captured by the louvers for collection or drainage. Each DOW assembly further includes a plurality of vertical members supporting the louvers in a spaced apart arrangement. The environmental window apparatus may further include a plurality of vertical rods fixed to the vertical members of each DOW assembly by fasteners in a spaced apart arrangement. The DOW assemblies are held in place by the plurality of vertical extension poles and the fasteners. The fasteners may be clamps or binder clips.

In some versions, each vertical member may include at least one horizontal ring or hook, where one of the plurality of vertical extension poles extends through the horizontal rings or hooks on the aligned vertical members. The vertical extension poles may be telescoping twist lock rods.

In another embodiment, each of the louvers may include a composite louver having at least first and second louvers overlapping at one end of the first and second louvers, the first and second louvers being slidable relative to each other so as to adjust an overall length of the composite louvers and enable infinite horizontal extendability. A vertical member may be positioned such that both louvers fit through the vertical member and be supported by the vertical member.

In another embodiment, the louvers may have holes at the bottom or the smaller end of the V-shape. The first and second louvers may be slidable relative to each other so as to align the holes on the first and second louvers in each of the louvers. The environmental window apparatus may further include a plurality of vertical rods each extending through one of the aligned holes in each of the louvers, thereby locking the composite louvers in place. The plurality of holes of each louver may be unequally spaced.

BRIEF DESCRIPTION OF THE DRAWINGS

FIGS. 9A-9C show how DOW devices may be equipped with the ability to be stacked on top of one another to maximize airflow while maintaining the same capability to keep the rain out;

DETAILED DESCRIPTION OF THE INVENTION

Figure 1:
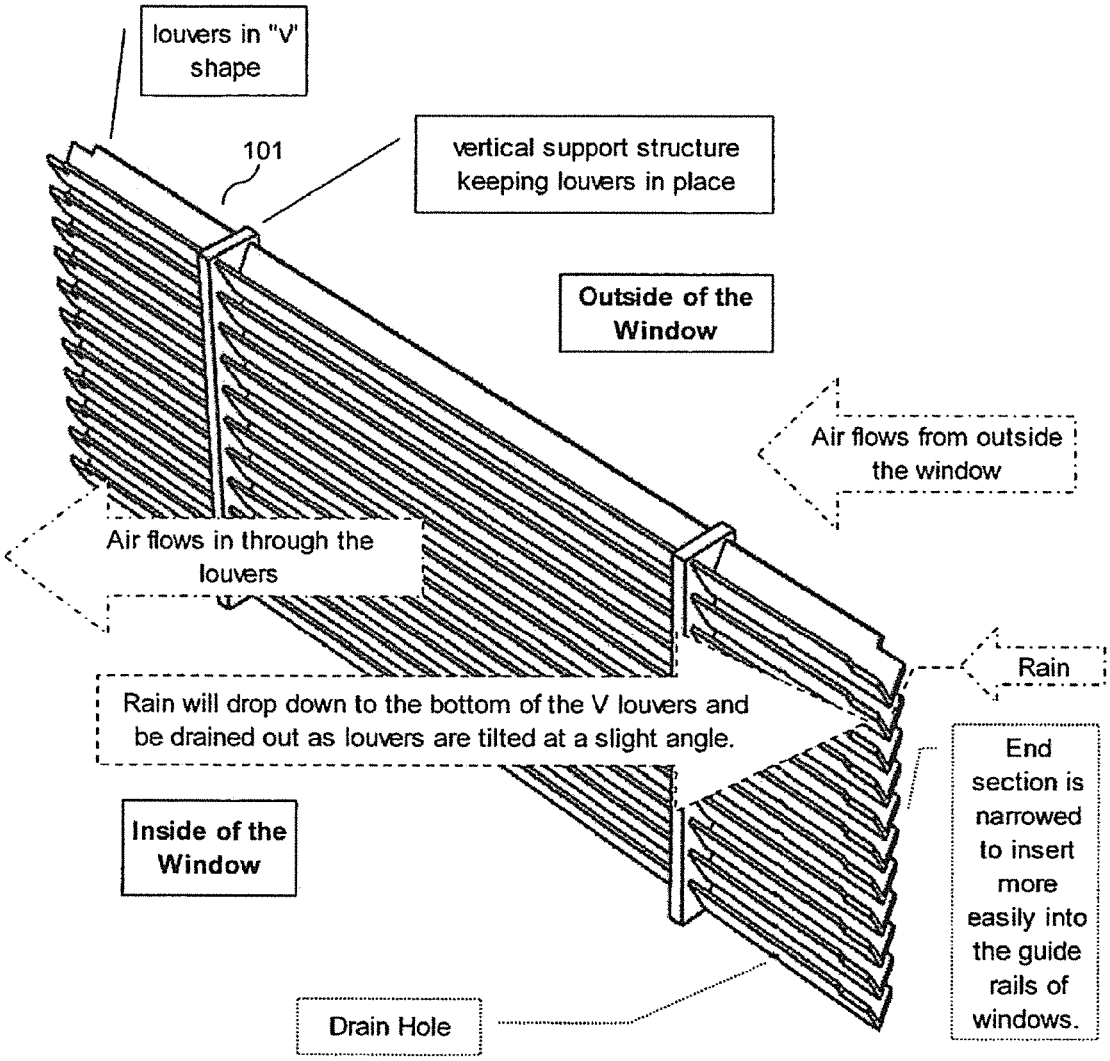
FIG. 1 is drawing of a prior art dry-open-window (DOW) device with "V"-shaped louvers.

By way of review, FIG. 1 is an illustration of a DOW device, demonstrating how "V"-shaped louvers let air flow from outside a window through the device into a living space while keeping precipitation out. As disclosed in pending U.S. patent application Ser. No. 12/836,574, louvers with other cross sections, including "W" and "S" shapes may be used. The improvements disclosed herein are fully compatible with all of the embodiments described in my published '574 Application, including drainage structures and, indeed, the improvements are also compatible with my previously disclosed DOW fan concepts.

Certain of the improvements disclosed herein reside in attachment mechanisms enabling DOW structures to be custom mounted to randomly sized openings. The DOW devices are enabled with a series of attachment tools that will allow the device to be attached to any opening, window, door, or any other part of a structure, in all cases to let air in but keep the rain out.

Extendable Frame Embodiment

Figure 2A:
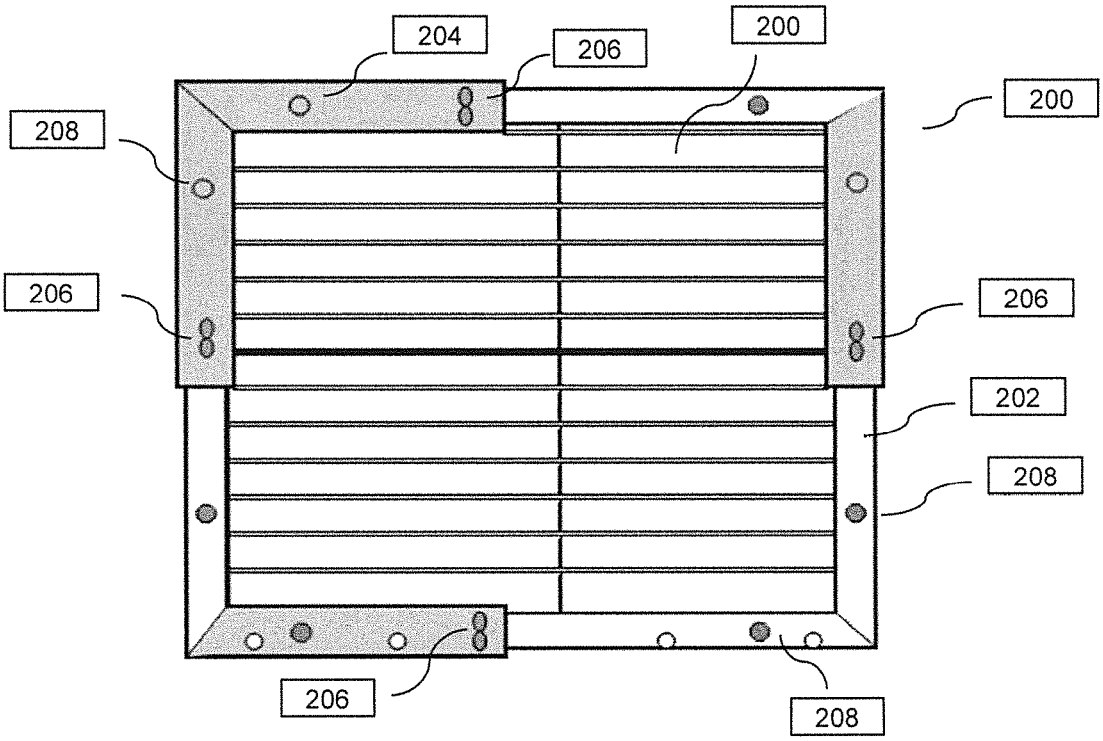
FIG. 2A is a drawing that shows an extendable frame embodiment of the invention.
Figure 2B:
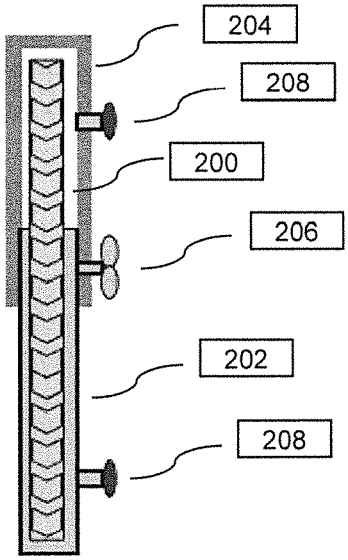
FIG. 2B is a cross-sectional view of the embodiment of FIG. 2A seen from the top.
Figure 2C:
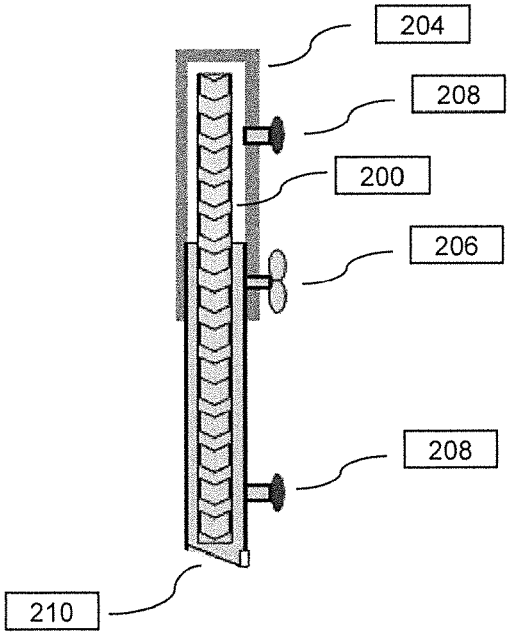
FIG. 2C is a cross-sectional view of the embodiment of FIG. 2A seen from the side.

FIG. 2A is a drawing that shows an extendable frame embodiment of the invention depicted generally at 200. FIG. 2B is a cross-sectional view from the top, and FIG. 2C is a cross-sectional view from the side. The DOW device is shown at 201. The extendable feature is achieved by inserting a smaller tubular frame 202 into a larger tubular frame 204 whose hollow diameter is just big enough to allow the smaller tubular frame to glide into it.

The vertical sliding feature allows the extendable frame to accommodate various heights, and the horizontal sliding feature allows the extendable frame to accommodate various widths. Once the desired dimensions are achieved, screw-like bolts 206 can be tightened to disallow further movement of the frame. As shown at 210, a sloped bottom of the frame may be provided to allow water or rain to drain outside the window.

Attachment points 208 are nuts and bolts that will attach the extendable frame to the fixtures that will attach the whole device to the existing structure. Nuts of one kind or another are used for tightening; other attachment parts can be used alternatively for attachment, such as hooks, ropes, or Velcro, at the same or similar attachment points.

In summary, the frame features in this embodiment are extendable in height and width, and the attachments utilize devices such as screws, hooks, ropes, or other devices, that enable the device to be attached to the frame of the opening from the outside or inside. The extension feature is enabled by the use of interlocking channels, where one fits snugly into the hollow of another and is able to slide in and out.

The extension feature is provided on all four sides, and is attached to the DOW device with screws, nuts and bolts or other suitable fasteners. To attach the frame to an existing structure, the customer sizes the DOW device, attaches the DOW device to the frame provided at instructed points, and then holds the right-sized DOW device to the opening to gauge where the attachments points will be. The installer then can choose from a selection of attachment devices provided to attach the frame to the structure.

Screws are used as an option to attach the extendable frame (along with the DOW device) to an existing structure. A set of screws of adequate length are provided to go through predrilled holes in the extendable frame and into the existing structure. Preferably the screws are weather resistant; will have an adequate length to drill into wood, brick or concrete; and may be able self-tapping for use with aluminum or steel. As a further option, ropes may be provided enabling users to tie the extendable frame to an existing structure at various selected attachment points.

'Twist and Tight' Embodiment

The "twist and tight" mechanism illustrated in FIG. 3 is used to pull a cable tight so that the DOW device is pulled tight against an existing window frame 300. As shown in FIG. 3A, this embodiment may be used with an extensible DOW device and optional overlying screen 302. FIG. 3B shows the screen in overlying registration with the DOW device and one twist and tight fastener 310. FIG. 3C is a top-down view showing the relationship between the component parts but without screen 302. Once the cable 304 is pulled, the installer twists a wing nut 306 on tube 308 to tighten the string against a tube.

Figure 3B:
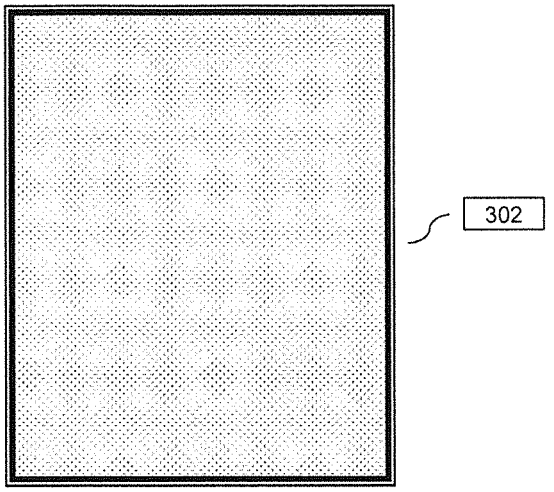
FIG. 3B shows the screen in overlying registration with the DOW device and one twist and tight fastener.
Figure 3B:
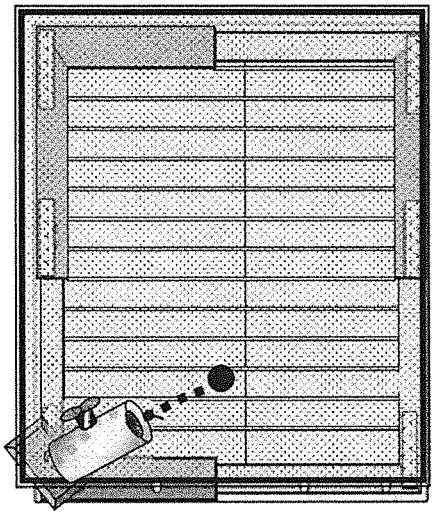
Figure 3A:
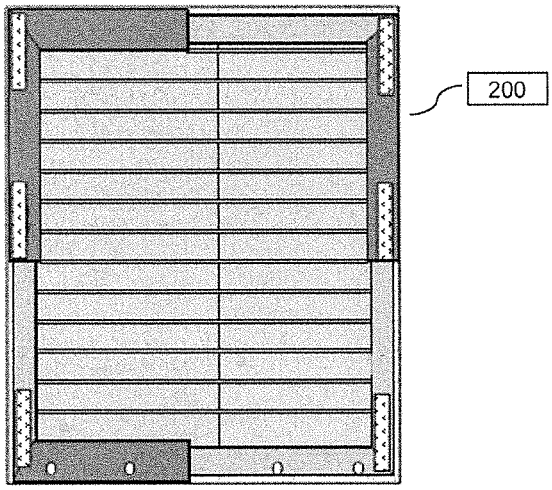
FIG. 3A illustrates an extensible DOW device and optional overlying screen.
Figure 3D:
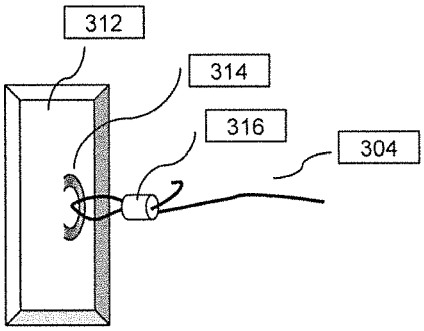
FIG. 3D is a detail drawing that shows how string may be anchored to a structure using a mounting plate.
Figure 3C:
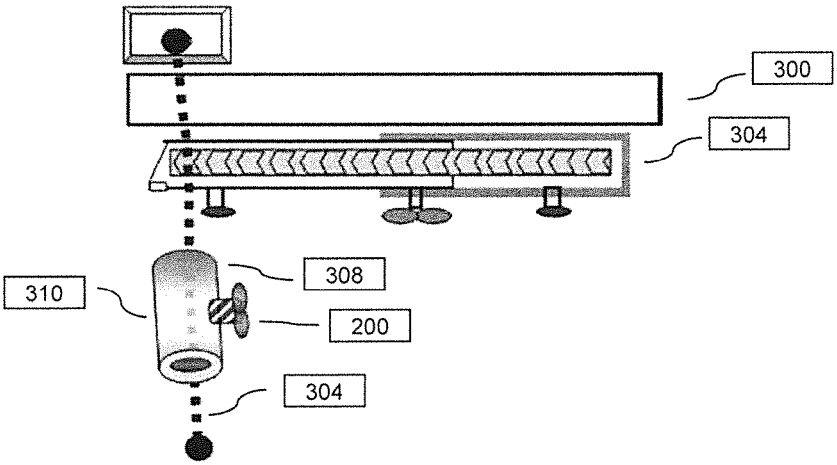
FIG. 3C is a top-down view showing the relationship between the component parts but without screen.

FIG. 3D is a detail drawing that shows how string 304 may be anchored to a structure using mounting plate 312. The base comprises a flat plate 312 with a small hook 314 attached to it. The steel cable is then looped through the hook and then fastened with a ring 316 that will crimped against the thin steel cable, as shown. Note that the positions of the base and the locking device can be switch from inside to outside.

The tightening device comprises a tube 308 whose inner diameter is slightly bigger than the steel cable 304 that runs through it. In FIG. 3B, the DOW device with the extendable frame is set against the window frame and against the screen. They are locked together with the locking mechanism demonstrated at the lower left-hand corner, with the understanding that more of the mechanisms may be used, in other corners, for example, as necessary. In the preferred implementation, there is a fastening mechanism for each corner of the window for secure attachment of the DOW device to the window.

A twisting mechanism may be provided that enables the steel cable to be pulled through with the tube with twist of a knob. The knob is attached to a rotating steel drum with teeth that pull the steel cable through as the knob is turned. The installer in this case is instructed to position a set of the twisters diagonally against the corner of the existing window frame. Four such twist and tight devices are provided, one for each corner of the DOW. As the thin flexible steel cord is pulled through, the distance is shortened between the DOW frame and the twister, which tightens the DOW frame against the existing window and the twister against inside window frame, thus tightening the device against the window.

Adhesive and Velcro Attachment Mechanisms

A suitable bonding agent may also be used as an option to attach the DOW device or the extendable frame to an existing window or the structure around an existing window. Adhesive materials with great adhesive power that holds up weights of 10 lb. or more will be used to attach the extendable frame to existing building structures to allow the DOW device to be installed to cover an opening.

In terms of installation, first the installer will attach the DOW device to the extendable frame. The installer then determines the attachment points for the extendable frame to be attached to the existing building structure so that the DOW device will cover the opening fully. With one person holding the frame (along with the DOW device attached), another person can extend or contract the extendable frame to figure out the best attachment points. Once positioned properly, the installer will be instructed to press the adhesive between the extendable frame and the surfaces of the existing structure. The adhesive will then firmly attach the extendable frame and the DOW device to the existing structure, and the DOW device will function properly at the opening to let air in and keep the rain out.

As an alternative to a permanent adhesive, hook-and-loop fasteners (Velcro) may also be used as a means to attach the DOW device or the extendable frame to an existing window or the structure around an existing window. Velcro is now available with great adhesive power that holds up weights of 10 lb. or more will be used to attach the extendable frame to existing building structures to allow the DOW device to be installed to cover an opening.

Figure 4B:
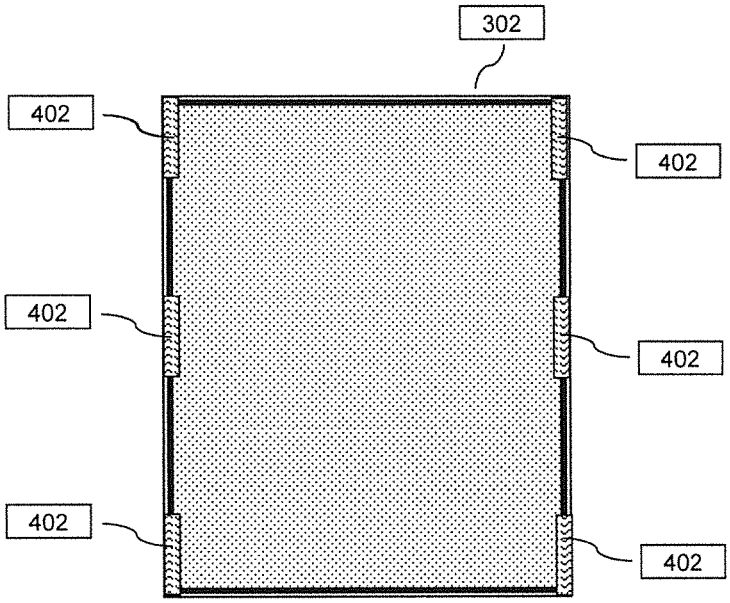
FIG. 4B is a side view showing the relationship of the components prior to assembly.
Figure 4B:
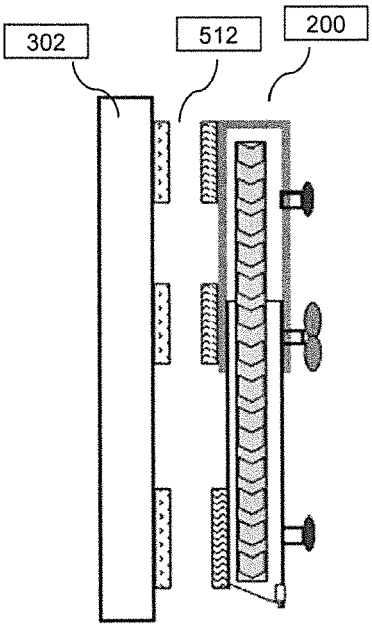
Figure 4A:
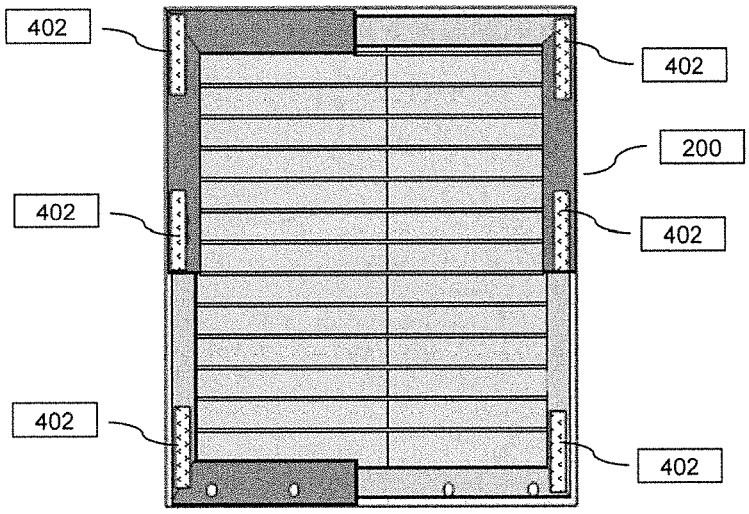
FIG. 4A shows Velcro pads attached to both the window frame and the DOW device, at matching points, so that when they are pressed against each other, they form a bound between them.
Figure 4C:
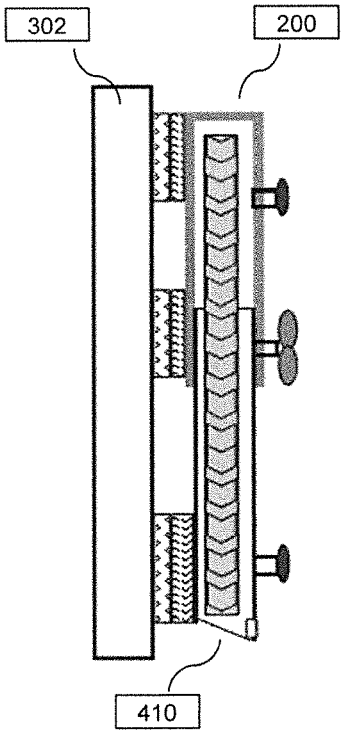
FIG. 4C is a side view showing the relationship of the components following assembly, when the window frame and the DOW extendable frame are pressed together.

As shown in FIG. 4A, Velcro pads 402 are attached to both the window frame and the DOW device, at matching points, so that when they are pressed against each other, they form a bound between them. Note that the extendable frame need not have the attachment nuts and bolts and screws, etc. Note further that the Velcro strips can run the entire lengths and widths of the frame in order for a complete seal. FIG. 4B is a side view showing the relationship of the components prior to assembly, and FIG. 4C is a side view showing the relationship of the components following assembly, when the window frame and the DOW extendable frame are pressed together.

In terms of installation, first the installer will attach the DOW device to the extendable frame, then determine the position of the attachment points for the extendable frame to be attached to the existing building structure so that the DOW device will cover the opening fully. With one person holding the frame (along with the DOW device attached), another person can extend or contract the extendable frame to figure out the best attachment points. One side of the Velcro attachment system is then attached to the existing structure via attachment parts, such as with screws or glue. The other side of the Velcro attachment system is then attached to the extendable frame in the same locations. Once positioned properly, the installer will be instructed to position the extendable frame so the two sides of the Velcro systems will meet and hooked to each other. The Velcro system will then firmly attach the extendable frame and the DOW device to the existing structure; and the DOW device will function properly at the opening to let air in and keep the rain out.

Again as depicted at 410, the attachments have special drainage channels to guide the precipitation away from the inside of the house or building. That is, the louver will be positioned slightly lower at both ends than the middle, thus guiding the rain to flow to the ends, such that the water or rain will drain at the ends downward. Since the ends will be incased in a guide channel, the water or rain will flow downward without the possibility to flow inside the house. The bottom of the frame will have a higher height on the side toward the inside of the house and have a lower height toward the outside of the house, such that the bottom of the frame will form a slope toward the outside of the house. At the edge of the outside slope, there will be weep holes at certain intervals level with the lowest point of the bottom of the frame. When the water or rain reaches the bottom of the frame of the DOW device, it will follow the slope and drain outside the frame through the weep holes.

The various attachments may include airtight padding materials attached to the attachment frames or other devices, thus enabling the device and the attachments to contact building structures without any damage. All embodiments may have a removable screen that protects the occupants from mosquitoes, insects, and other small creatures that may invade the space protected by the DOW. The screen may be attached permanently or temporarily to the DOW device, while still allowing air to move through the DOW freely.

The screen may be attached to the extendable frame, which houses the DOW device. Strips of Velcro may be used for temporary attachment whereas screws may be used for more permanent attachment. Ropes, single-/double-sided tapes, or nuts and bolts may be used for temporary or permanent attachment.

Rod-and-Hook Mounting Configurations

Figure 5A:
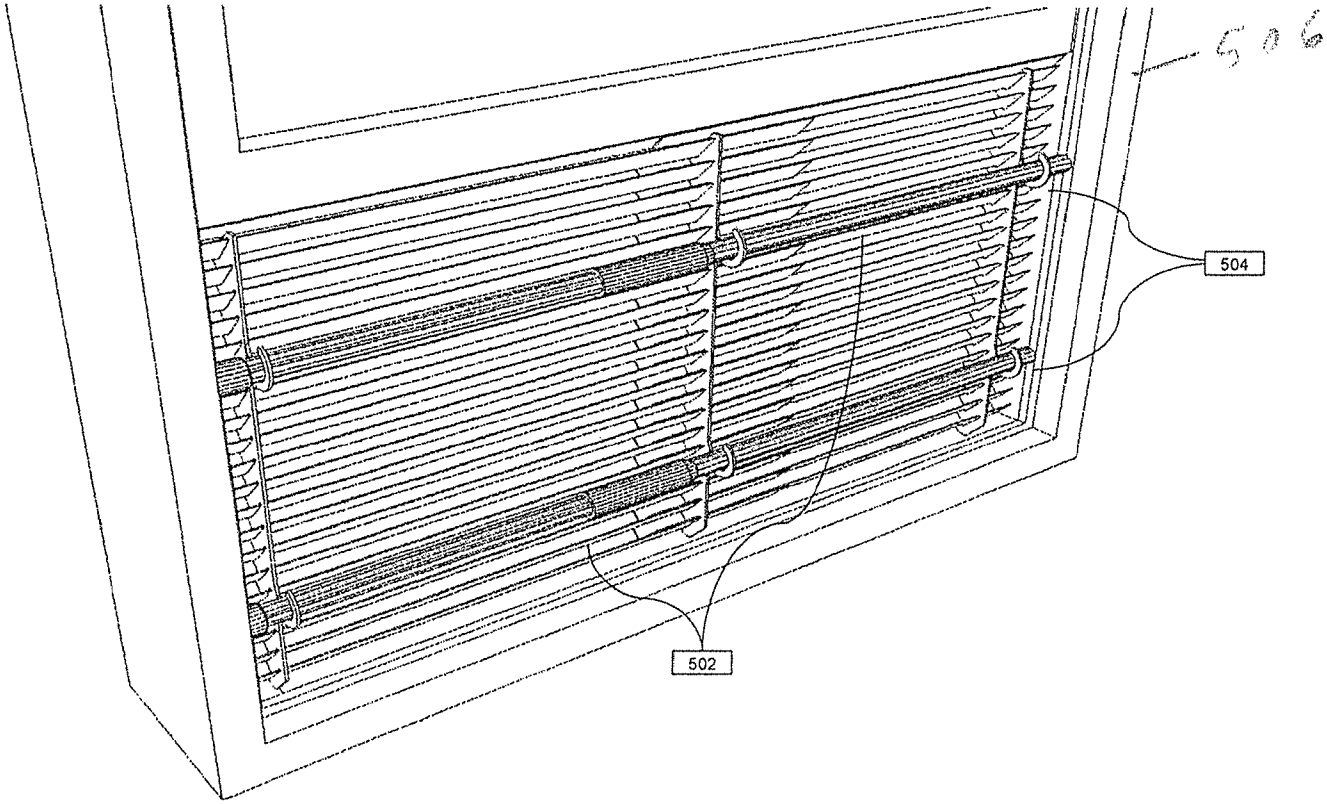
FIG. 5A is an oblique drawing that illustrates a rod-and-hook DOW mounting configuration.
Figure 5B:
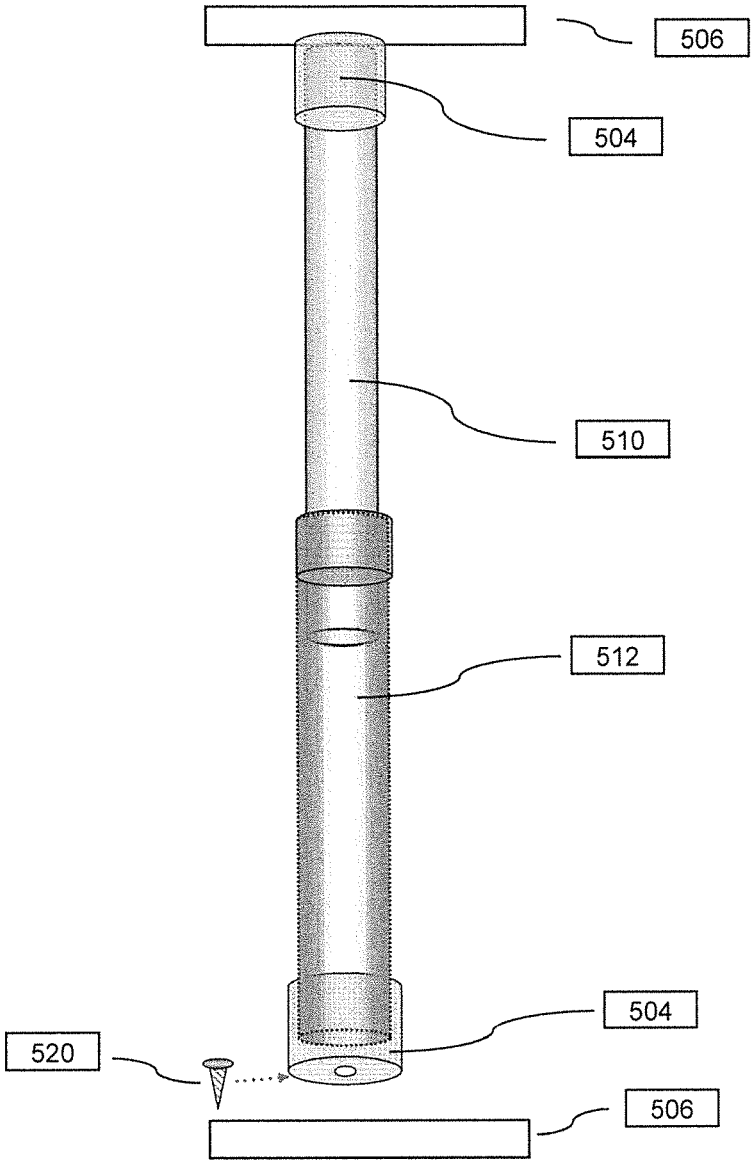
FIG. 5B is a detail drawing of a rod.
Figure 5D:
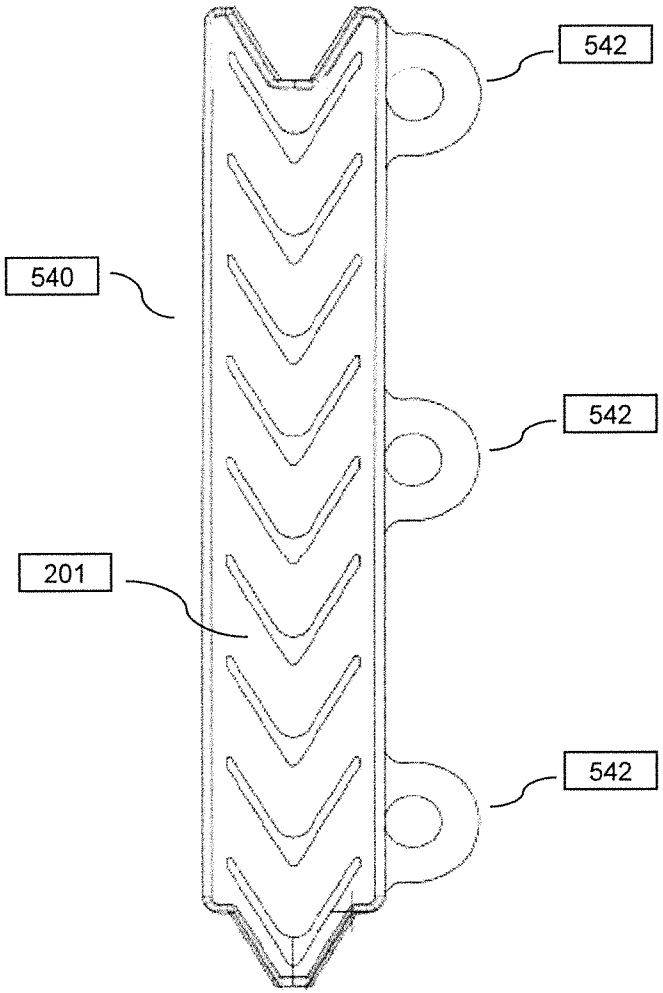
FIGS. 5C and 5D are side views of DOW devices having hooks or other structures that engage with the rods.
Figure 5C:
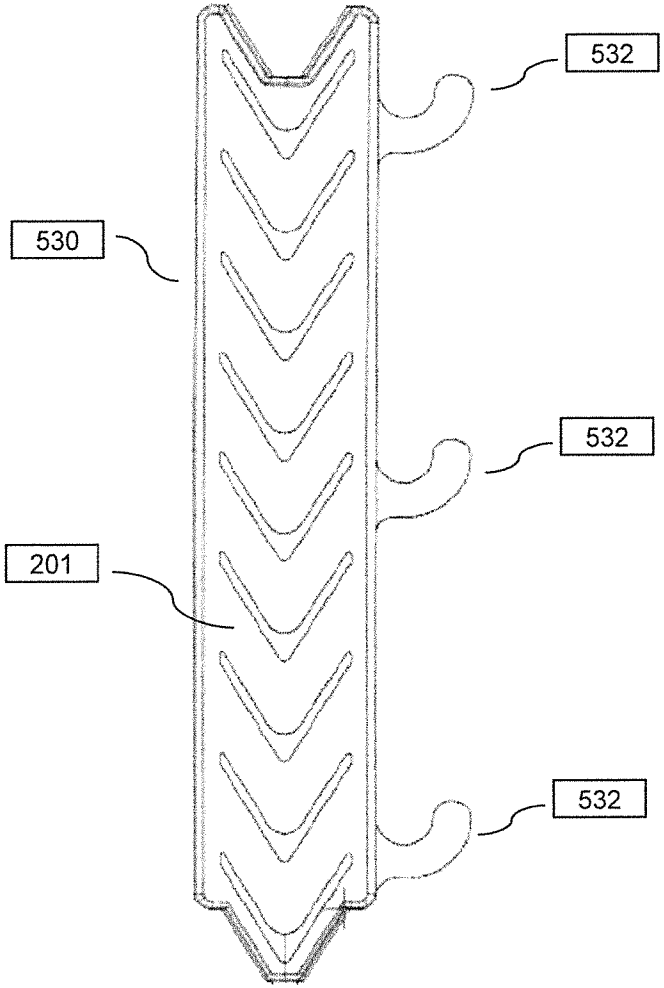

FIG. 5A is an oblique drawing that illustrates a rod-and-hook DOW mounting configuration. In this embodiment, one or more rods 502 with end caps 504 are supported across a window or other opening 506. FIG. 5B is a detail drawing of a rod, and FIGS. 5C and 5D are side views of DOW devices having hooks or other structures that engage with the rods.

The thicker of the two tubes in the extension pole, its inter diameter is slightly bigger than the outer diameter of the slenderer tube, to allow the slenderer tube to slide back and forth, thus enabling the extension of the rod to varying lengths. The slenderer of the two tubes 510 in the extension pole will be able to slide in and out of the thicker tube 512 to achieve extension to varying lengths, to fit into windows of varying widths.

A twist lock mechanism 514, when twisted loose, allows the slenderer tube to pass through back and forth and then lock it up when twisted tight. There are commercially available twist lock products in the market that will tighten or loosen when the ring is turned one way or the other.

There is an end cap 504 at both ends. The cap has a hole to allow a screw 520 to pass through and attach the end cap to the window frame. When fixed to the window frame, it will receive the rod and hold the rod in place. In terms of dimensions, the length of each tube may be on the order of 25 inches; the diameter of the tubes are ½ inch for the slenderer tube; make the walls of the tubes and end caps about 50/1000 inch; therefore, render the diameters of the end caps and the thicker tube accordingly.

Figure 5E:
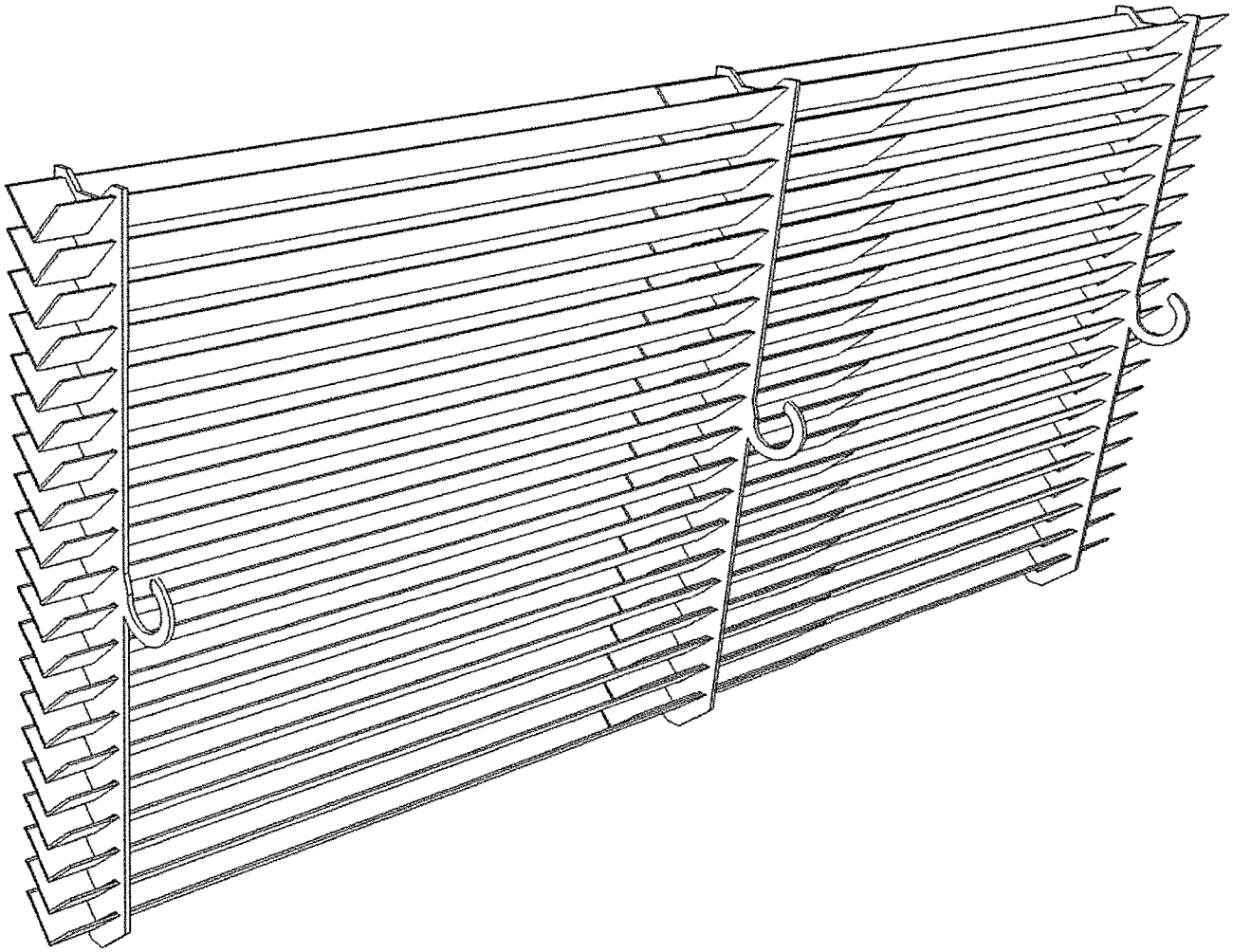
FIG. 5E is an oblique drawing of a DOW device equipped with hooks of FIG. 5C.

FIG. 5C is a side-view drawing of a DOW device 530 having hooks 532 that are spaced-apart to engage with rods supported within a window frame or other opening. FIG. 5D is a side-view drawing of an alternative DOW device 540 having through-holes 542 that are spaced-apart to receive rods supported within a window frame or other opening. The embodiment of FIG. 5D is similar to that of FIG. 5C except that it is more secure in the sense that the rods must be removed to move or remove the DOW device. FIG. 5E is an oblique drawing of a DOW device equipped with hooks of FIG. 5C.

The hooks or loops enable the extendable rod to go through them to the opposing walls. A socket with a diameter slightly larger than that of the extendable rod is attached to the opposing walls of the opening via a screw or other similar device. The extendable rod extends into the sockets and can be twisted tight to fix it in place. This ensures the louvers and the DOW device will stay in place despite moderate force exerted against it by either pushing or pulling the device.

Dow Tent Structures

Figure 6A:
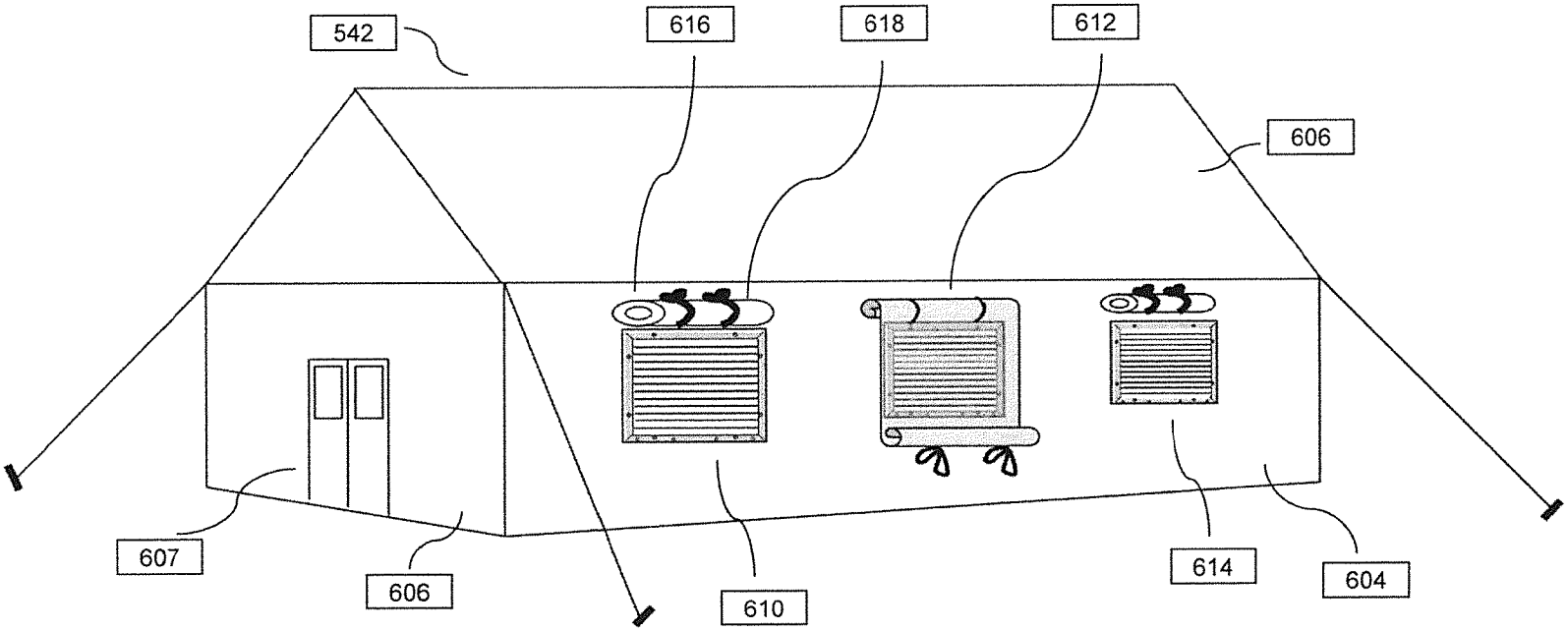
FIG. 6A shows a DOW arrangement suitable to tent structures.
Figure 6B:
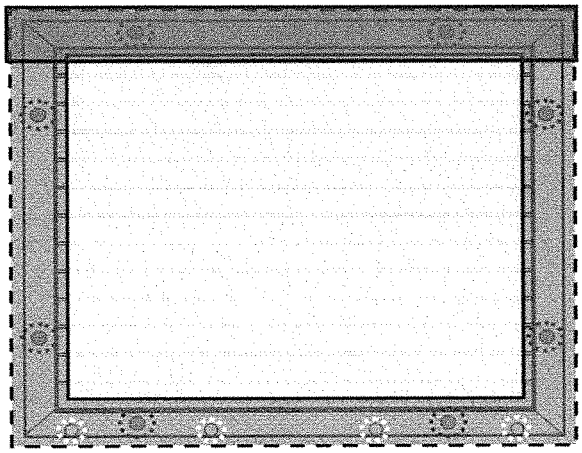
FIGS. 6B-6D illustrates different views of a DOW application for tent structures.
Figure 6C:
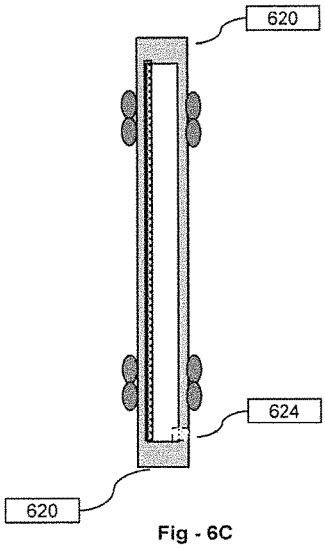
Figure 6D:
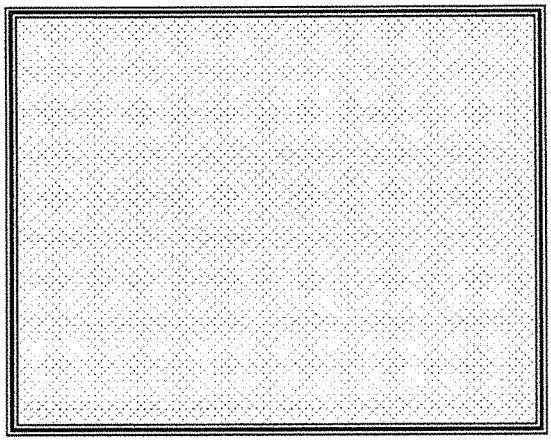

FIG. 6A shows a DOW tent structure 606 with windows 614 that have DOW devices 610 inserted in them. As shown in FIG. 6B, the window frames 620 have a bottom sill 622 built in such a way that the bottom slopes downward towards the outside of the tent, with weep holes 624 at the very bottom of the sill at both ends and in the middle, to allow precipitation to drain outside the window and the tent.

Some tents can be made with DOW devices imbedded in them permanently, while allowing flaps 618 to cover up the window in extremely inclement weather. Some tents can be made with the DOW devices that can be removed for ease of folding and also for easy replacements. To enable the removal and reinstallation of the DOW, the tent can have the frame built into the tent, so the frame it a permanent fixture.

Alternatively, if the frame is not permanently attached to the tent, it may be attached to the tent via a series of hooks, screws, holes, and other means of attachment. The tent window is then purposefully designed and manufactured to accept the DOW with a frame. As a further alternative, the tent may include a canvas frame with a flap at the top or any side, which, when opened, can allow the DOW device to be insert into the canvas frame. The DOW device may also have attachments enabling it to be attached to existing tents. In any case, the DOW devices will have dimensions that will cover the vast majority of tent windows.

The DOW device may have a series of attachments in the form of screws, hooks, ropes, snaps, and other such fasteners to allow it to be attached to a tent window with little modification and overall ease. The DOW device may also have a locking mechanism to secure the louvers in place. The various supports may have hooks or loops that extend inside the space that the DOW protects.

Louver Angle Adjustment

Figure 7A:
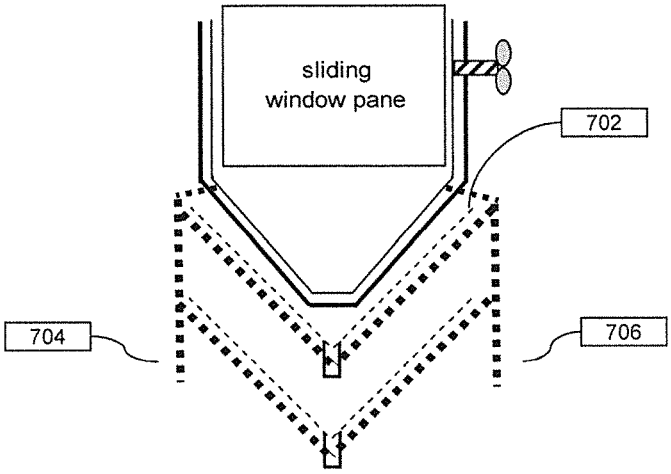
FIG. 7A is a side, cross-sectional view of a louver angle adjustment mechanism.

In yet a further alternative embodiment, the DOW devices may be equipped with the ability to adjust the angles of the louvers to control the air flow or to shut down the air flow altogether. In this case, as shown in FIG. 7A, louvers 702 are connected with rope ladder 704, 706. As the rope ladder is pulled up or down at one side, the louvers will move accordingly. The rope ladder is connected to each louver through a hole in the louvers at defined intervals, especially at the ends, with a stopper at the underside of each louver, to enable the rope ladder to lift or lower the side of the louver the rope is on as the rope of the side is lifted or lowered.

Figure 7B:
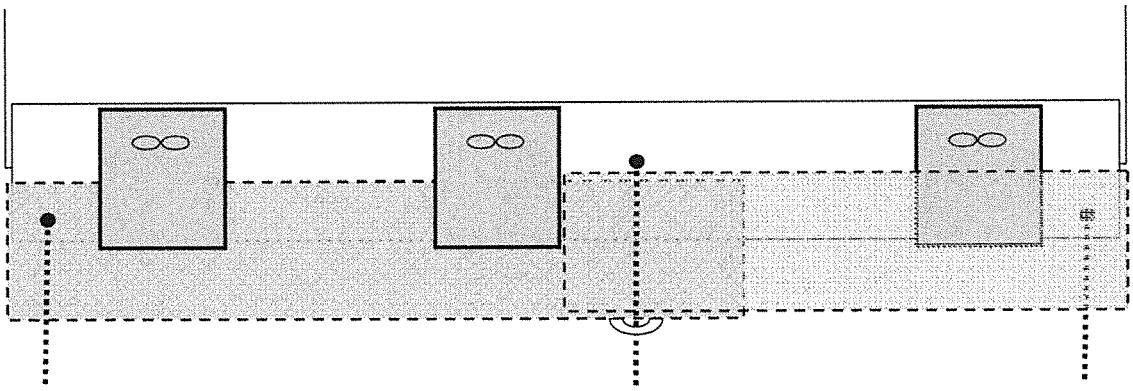
FIG. 7B is a front view of the louver angle adjustment mechanism.

FIG. 7B is a front view of this embodiment. The middle sections of the louvers are only saddled (without holes running through the louvers) by the rope ladder, which enables the upper sliding louvers to extend or contract to fit in windows of all sizes. The rope ladder for the middle sections may or may not be fixed to the underside of the lower louvers for rigidity or ease of assembly and operation.

The rope ladder is connected to a bar at the top that can extend, along with the sliding louvers, from a certain length to a greater length, to allow the DOW to fit in a wide variety of window openings. The mechanism to lift or lower one side of the louvers is achieved in a gear (not shown) in the bar at the top. The ropes run through a teethed rod that will rotate will the gears of a turning rod, which is controlled by the customer, like that of Venetian blinds. The louvers can also be connected to a rotary lever system to control the amount air flow through the opening by using various mechanisms. In one example, the user turns a long thin rod, the other end of the rod rotates as well. The other end of the rod is connected, through a lose connector that allows the thin rod to be detached, to a rotary mechanism.

The rotary mechanism may be toothed with rod running through it. As the rotary mechanism is turned by the thin rod, it rotates the rod. The rod is firmly attached to a piece of rigid material that runs the length of the DOW. The two long sides of the level piece are loosely attached at intervals with looped hooks to rigid vertical pieces, so that when the level piece pivots up or down, the rigid vertical pieces will move up and down in accordance. The rigid vertical pieces are connected loosely by a connector, such as a closed hook, to the horizontal louvers, such that the horizontal louvers move up and down with the rigid vertical pieces as they are moved up and down by the rotary mechanism. Using this arrangement, with a twist of the think rod, the louvers can be closed or be opened to the desired open setting, allowing the customer the desired amount air flow or no passage at all.

Collapsable Configurations

Figure 8A:
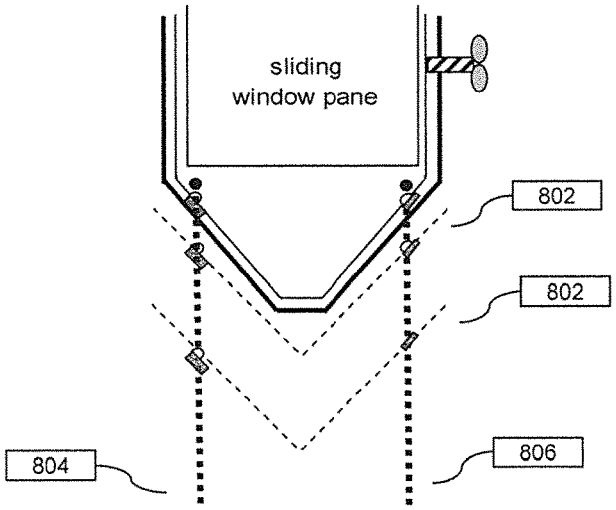
FIG. 8A is a side, cross-sectional view of a DOW collapsing mechanism.
Figure 8B:
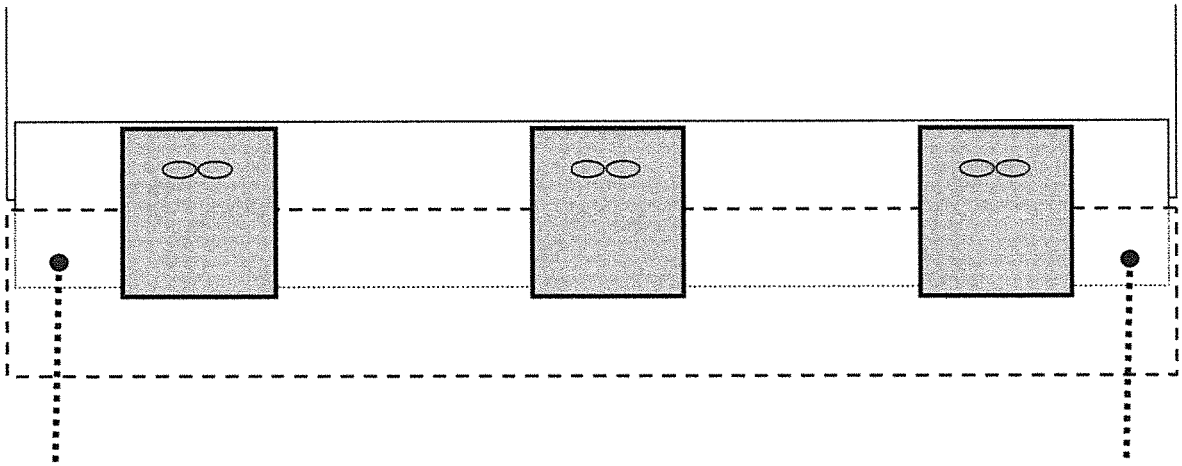
FIG. 8B is a front view of the DOW collapsing mechanism.

In the embodiment of FIGS. 8A, 8B, the DOW device has the capability to be collapsed into a small space for easy storage or extended to fill the opening. FIG. 8A is a partial cross section; FIG. 8B is a frontal view. The louvers 802 can be attached by strings 804, 806 that allow the user to fully or partially expand the device upward by pulling the top of the device. The DOW louvers are attached to the top of the device and strung together via a series of rope ladders. The rope ladders are attached to the louvers through holes in the louvers.

The rope ladders have fixed intervals that lift and separate the louvers at regular intervals when the rope ladders are lifted. The rope ladders also allow the louvers to collapse and be folded into a small pile. The rope ladders are attached to the V Top device. The V Top will be attached to the bottom of the window in various ways. It may also be attached to the bottom of the moveable window pane via the device of a clamped U shape that fits onto the bottom of the moveable window. Alternatively, it may be attached to the supporting rods at either end.

Stacking Capabilities

As shown in FIGS. 9A-C, the DOW devices may be equipped with the ability to be stacked on top of one another to maximize airflow while maintaining the same capability to keep the rain out. The top and the bottom of each DOW device are stacked on top of each other in cooperating alignment. The key feature that enables stacking is the shape of the top and bottom of the vertical support pieces 902. The tops of the support pieces, FIG. 9C are shaped with a concave profile 910. The bottoms of the support pieces, FIG. 9B, are shaped with a converse profile 912. The concave and converse shapes of the tops and the bottoms enable a perfect mate of the two pieces, enabling them to fit each other perfectly. The stacking is designed in such a way that there is no gap between the two devices stacked on top of each other, thus maintaining the devices' capability to keep the rain out while letting air flow through.

Figure 10:
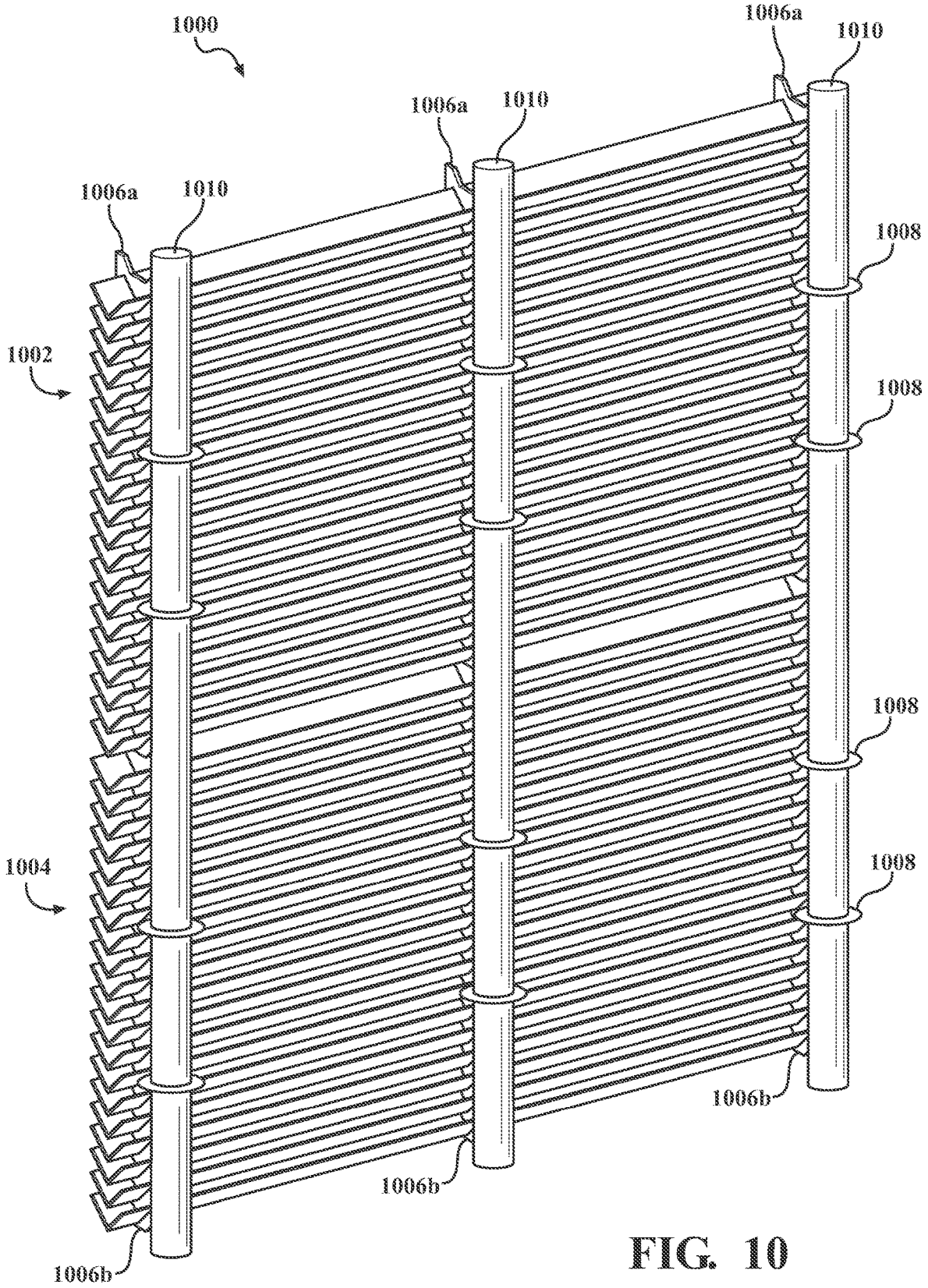
FIG. 10 is a perspective view showing two DOWs stacked together and held by a plurality of rods in accordance with an embodiment of the present invention.
Figure 11:
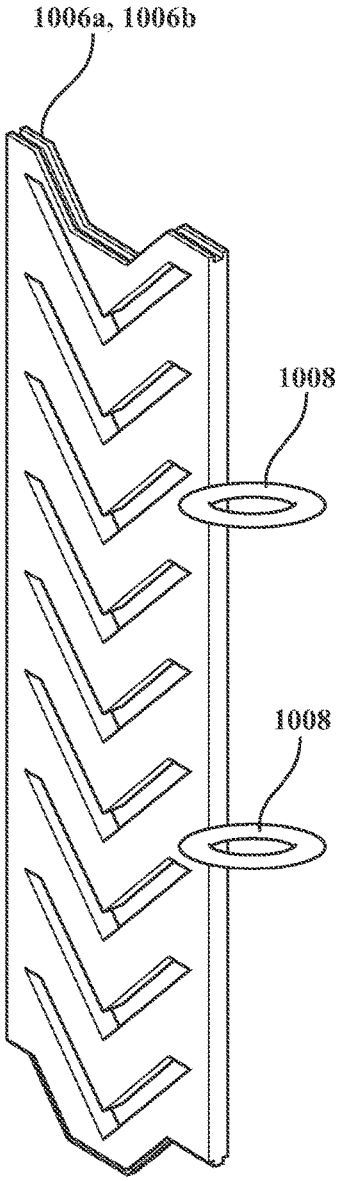
FIG. 11 is a perspective view showing a vertical member provided with horizontal rings in accordance with an embodiment of the present invention.

The DOW device may be configured to have infinite stacking capability. FIG. 10 shows an example of two DOW devices 1002, 1004 stacked on top of each other and held together by a plurality of rods 1010. The DOW device 1002 is supported by a plurality of vertical members 1006*a*. The DOW device 1004 is supported by a plurality of vertical members 1006*b*. FIG. 11 shows an example of the vertical members 1006*a*, 1006*b* used in FIG. 10. The vertical members 1006*a*, 1006*b* are provided with a plurality of horizontal rings or loops 1008 on one side. A plurality of vertical extension poles 1010 are provided through the rings 1008 to hold the DOWs 1002, 1004 together and in alignment. The rings 108 are 3-D rings having a thickness. The rings 1008 are made to be strong enough to hold the extension poles.

The vertical extension poles 1010 may be the same twist lock rods as illustrated in FIG. 5B.

The thicker of the two tubes in the extension pole, its inner diameter is slightly bigger than the outer diameter of the slenderer tube, to allow the slenderer tube to slide back and forth, thus enabling the extension of the rod to varying lengths. As shown in FIG. 5B, the slenderer of the two tubes 510 in the extension pole will be able to slide in and out of the thicker tube 512 to achieve extension to varying lengths, to fit into windows of varying widths.

Figure 12:
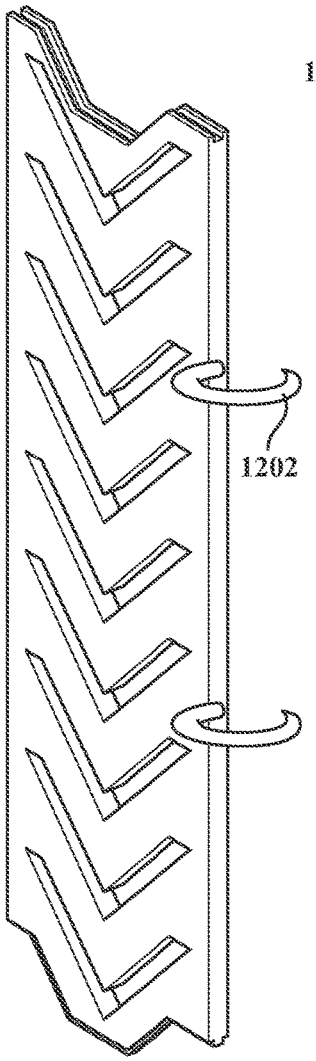
FIG. 12 is a perspective view showing a vertical member provided with horizontal hooks in accordance with an embodiment of the present invention.
Figure 13:
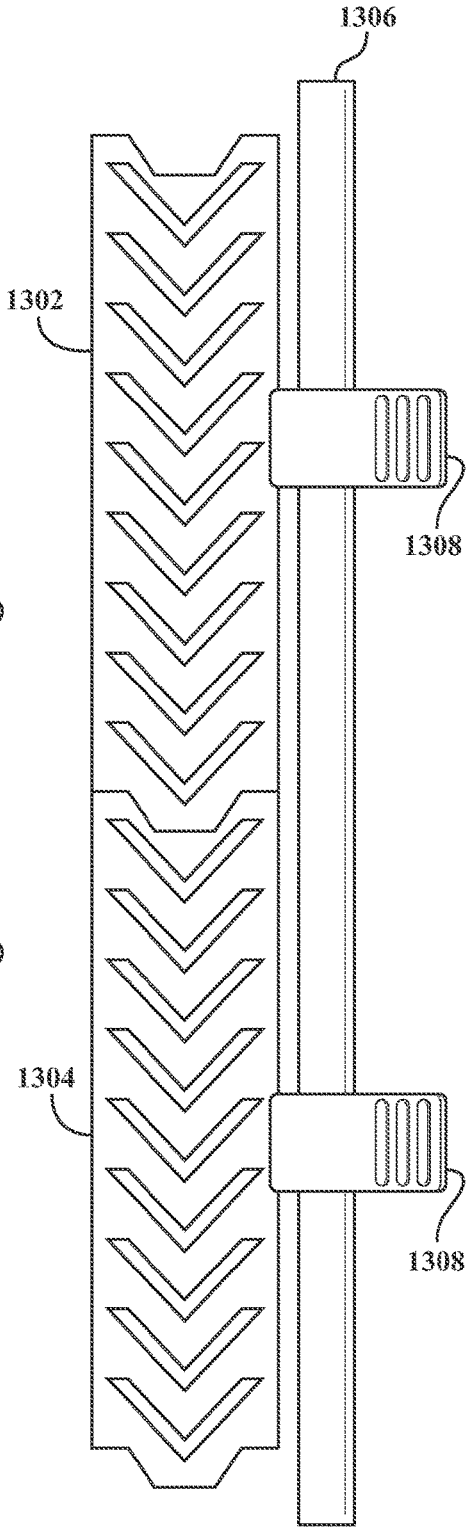
FIG. 13 is a side view showing a vertical member held together with a vertical rod by clamps.

In another version, the rings 1008 may be replaced by horizontal hooks 1202, as shown in FIG. 12. The hooks 1202 are made with a thickness and not flat so that the hooks are strong enough to hold the extension poles. In another version, clamps are provided to secure the rods to the vertical members. As shown in FIG. 13, two vertical members 1302, 1304 are stacked on top of each other and fit together perfectly. An extension pole 1306 stands vertically and is clamped to the vertical members 1302, 1304 by clamps 1308. The vertical members 1302, 1304 may also have horizontal rings or hooks which are not shown in FIG. 13. The extension pole 1308 may be a telescoping twist lock rod and can be adjusted such that additional DOWs nay be stacked. The vertical members 1304 may be constructed to be the same as the vertical members shown in FIGS. 5C and 5D, having a raised rim around the edge of the vertical members for the clamps to be steadily secured to.

Figure 14:
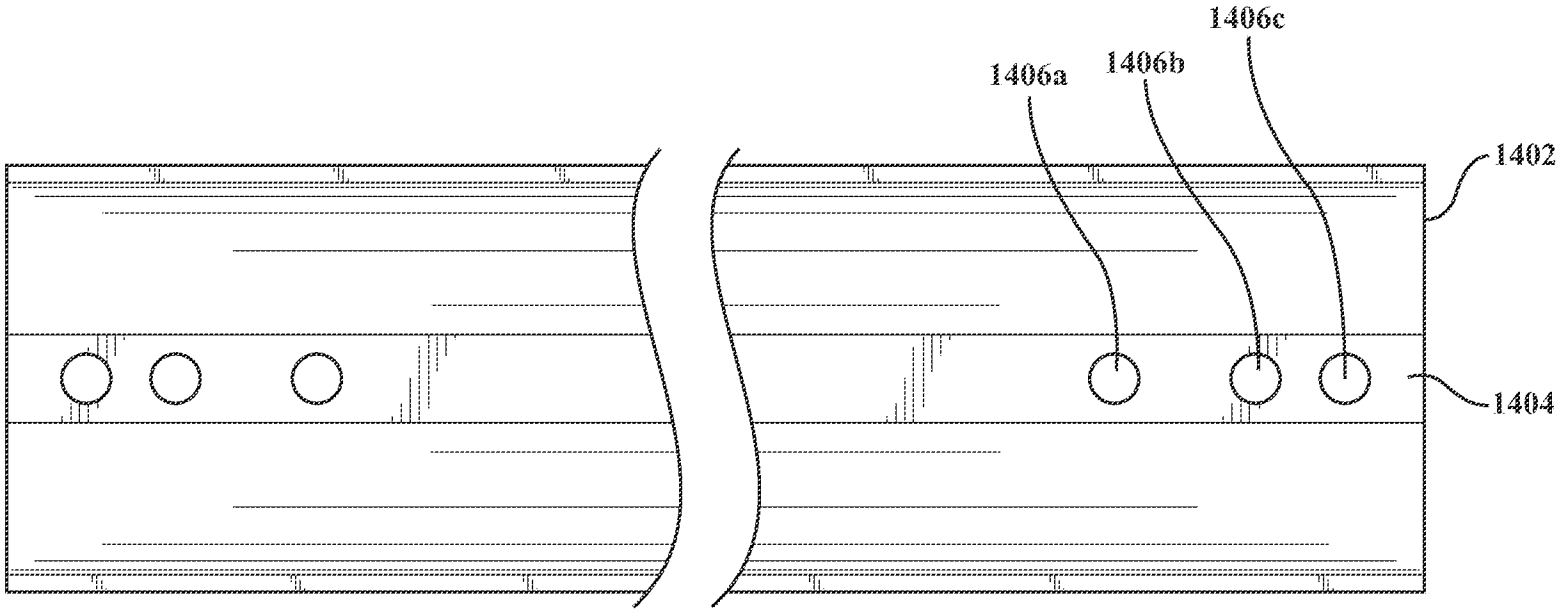
FIG. 14 is a top view of a louver having holes at the bottom for receiving rods in accordance with an embodiment of the present invention.

The infinite stacking capability of the DOW device can also extend horizontally. FIG. 14 shows a louver 1402 in accordance with one embodiment of the present invention. The louver 1402 is provided with a plurality of holes 1406*a*, 1406*b*, 1406*c*, which are unequally spaced. The louver 1402 shown in FIG. 14 includes a flat bottom 1404. In another embodiment, the louver may be just a V-shape without a flat bottom.

Figure 15:
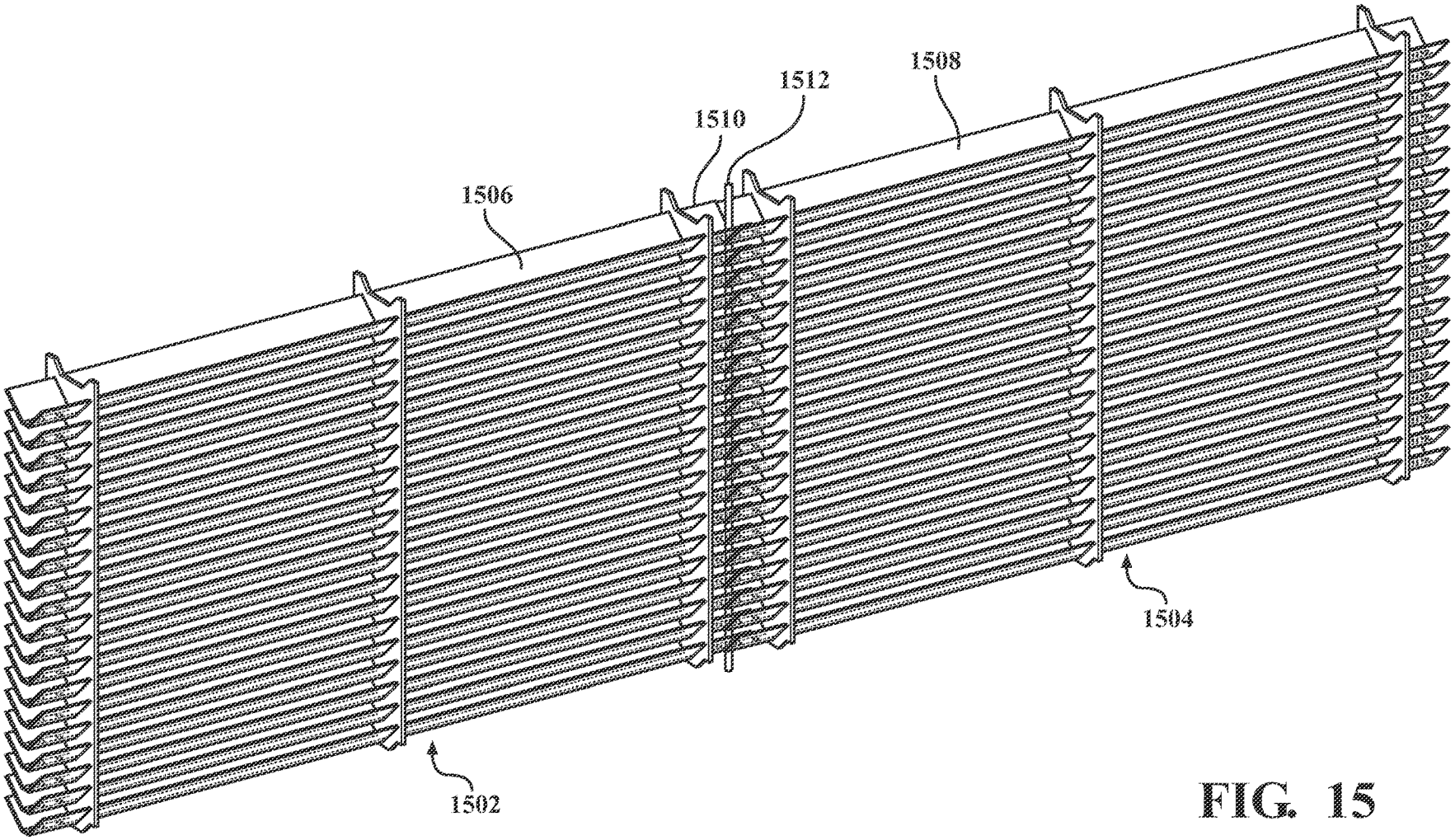
FIG. 15 is a perspective view showing two DOWs overlapped and held by a rod through the holes in the louvers in accordance with an embodiment of the present invention.

FIG. 15 shows an example of two DOW devices 1502, 1504 partially overlapped at one end 1510 of each DOW device. Each louver 1506 of the DOW device 1502 overlaps with corresponding louver 1508 of the DOW device 1504 such that some of the holes in the louver 1506 align with some of the holes in the louver 1508. Two DOW devices 1502, 1504 may be held together by a vertical rod 1512 which extends through the aligned holes from top louver through all the louvers to the bottom louver. The unequally spaced holes are preferably positioned so that the combined horizontal length is adjustable to nearly any length and holes will align to allow locking. Additional DOWs may be horizontally arranged to further extend the assembly. Horizontal and vertical stacking may be combined to fill any type of window openings.

The vertical rod 1512 is optional. In another embodiment, a vertical member 1510 or 1512 may be positioned at the overlapping parts of the louvers 1506, 1508 to support the louvers and enable infinite horizontal extension of the louvers. The louvers in FIG. 15 appear to have a flat bottom. In another version, the louvers may be V-shaped and not have a flat bottom, the same as what is shown in FIG. 10.

As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the invention.

The invention claimed is:

1. An environmental window apparatus, comprising:

at least two dry open window (DOW) assemblies, each DOW assembly comprising:

a dry open window (DOW) structure having a plurality of louvers which, when viewed in cross section, are formed in the shape of a "V" or "W" that enable air to pass through a window opening while limiting passage of precipitation, the "V" shape disposed with a narrower end pointed downward and two portions sloping upwardly therefrom or the "W" shape disposed with two narrower ends of the shape pointed downward and two portions sloping upwardly from each of the narrower ends such that the precipitation instead is captured by the louvers for collection or drainage; and a plurality of vertical members supporting the louvers in a spaced apart arrangement; and a plurality of vertical extension poles fixed to the vertical members of each DOW assembly by fasteners in a spaced apart arrangement, wherein one of the at least two DOW assemblies is stacked on the other and the corresponding vertical members are aligned, and wherein the DOW assemblies are held in place by the plurality of vertical extension poles and the fasteners.

2. The environmental window apparatus of claim 1, wherein the fasteners are clamps or binder clips.

3. The environmental window apparatus of claim 1, wherein each vertical member includes at least one horizontal ring or hook, wherein one of the plurality of vertical extension poles extends through the horizontal rings or hooks on the aligned vertical members.

4. The environmental window apparatus of claim 1, wherein the vertical extension poles are telescoping twist lock rods.

5. An environmental window apparatus, comprising:

a dry open window (DOW) structure having a plurality of louvers which, when viewed in cross section, are formed in the shape of a "V" or "W" that enable air to pass through a window opening while limiting passage of precipitation, the "V" shape disposed with a narrower end pointed downward and two portions sloping upwardly therefrom or the "W" shape disposed with two narrower ends of the shape pointed downward and two portions sloping upwardly from each of the narrower ends such that the precipitation instead is captured by the louvers for collection or drainage, each louver having a plurality of holes at the narrower end;

a plurality of vertical members supporting the louvers in a spaced apart arrangement;

each of the louvers comprising a composite louver having at least first and second louvers overlapping at one end of the first and second louvers, the first and second louvers being slidable relative to each other so as to adjust an overall length of the composite louvers and so as to align the holes on the first and second louvers in each of the louvers; and a plurality of vertical rods each extending through one of the aligned holes in each of the louvers, thereby locking the composite louvers in place.

6. The environmental window apparatus according to claim 5, wherein the plurality of holes of each louver are unequally spaced.

* * * * *